US005692651A

United States Patent [19]

Fuchs

[11] Patent Number: 5,692,651

[45] Date of Patent: Dec. 2, 1997

[54] SELF-SEALING DISPENSING CLOSURE

[75] Inventor: Timothy J. Fuchs, Perrysburg, Ohio

[73] Assignee: Owens-Illinois Closure Inc., Toledo, Ohio

[21] Appl. No.: 659,378

[22] Filed: Jun. 6, 1996

[51] Int. Cl.[6] ..... F16K 17/02

[52] U.S. Cl. ..... 222/494

[58] Field of Search ..... 222/212, 213, 222/491, 493, 494, 496

[56] References Cited

U.S. PATENT DOCUMENTS

| | | | |
|---|---|---|---|
| 2,016,037 | 10/1935 | Gruber . | |
| 2,628,004 | 2/1953 | Schlicksupp . | |
| 2,711,271 | 6/1955 | Schlicksupp . | |
| 3,053,407 | 9/1962 | Lowen . | |
| 3,134,517 | 5/1964 | Seybold . | |
| 3,203,603 | 8/1965 | Benson | 222/494 |
| 3,913,803 | 10/1975 | Laauwe . | |
| 4,057,177 | 11/1977 | Laauwe | 222/493 X |
| 4,061,254 | 12/1977 | Nilson | 222/494 |
| 4,102,476 | 7/1978 | Loeffler | 222/212 X |
| 4,141,474 | 2/1979 | Nilson . | |
| 4,349,134 | 9/1982 | Schuster et al. . | |
| 4,474,314 | 10/1984 | Roggenburg, Jr. . | |
| 4,506,809 | 3/1985 | Corsette . | |
| 4,739,906 | 4/1988 | LoTurco . | |
| 5,025,957 | 6/1991 | Ranalletta et al. . | |
| 5,033,647 | 7/1991 | Smith et al. | 222/212 X |
| 5,154,325 | 10/1992 | Ryder et al. . | |
| 5,183,184 | 2/1993 | Ranalletta et al. . | |
| 5,226,568 | 7/1993 | Newton et al. . | |
| 5,255,826 | 10/1993 | Ranalletta et al. . | |
| 5,320,254 | 6/1994 | Ranalletta et al. . | |

FOREIGN PATENT DOCUMENTS

| | | | |
|---|---|---|---|
| 1441112 | 4/1966 | France | 222/494 |
| 1586697 | 6/1967 | Germany | 222/494 |

*Primary Examiner*—Kevin P. Shaver

[57] ABSTRACT

A self-sealing closure assembly including a base having threads for attachment to a plastic flexible container. The base includes one passage therethrough and an axially extending stem. A flexible disc is provided on the base and has a central opening through which the stem extends into normally sealing relation with the central portion. An overcap including a base wall and a skirt is telescoped over the flexible disc and interengages the base for holding the flexible disc in sealing relation with the base and overcap. The overcap has an opening through which the stem and the central portion of the disc extend. When the closure assembly is placed on a container having squeezable walls and the container is squeezed, the central portion of the flexible disc is moved out of sealing relation with the stem to permit the contents to be dispensed. When the squeezing force is removed, the central portion of the flexible disc returns to sealing relation with the stem.

17 Claims, 6 Drawing Sheets

SELF-SEALING DISPENSING CLOSURE

This invention relates to dispensing closures and particularly to plastic self-sealing dispensing closures used with plastic squeeze bottles.

BACKGROUND AND SUMMARY OF THE INVENTION

In dispensing closures utilized with a plastic squeeze bottle, it is necessary to open the closure and then manually close the closure after the contents are dispensed by squeezing the plastic bottle.

Among the objectives of the present invention are to provide a closure for use with a container which is self-sealing and operates when the container is squeezed to open the closure for dispensing and to close the closure when the pressure on the container is released; which can be operated by only using one hand to open the sealed closure, dispense the contents and seal the closure and container.

In accordance with the invention, the self-sealing closure assembly comprises a base having means for attachment to a plastic flexible container. The base includes one passage therethrough and an axially extending stem. A flexible disc is provided on the base and has a central opening through which the stem extends into normally sealing relation with the central portion. An overcap including a base wall and a skirt is telescoped over the flexible disc and interengages the base for holding the flexible disc in sealing relation with the base and overcap. The overcap has an opening through which the stem and the central portion of the disc extend. When the closure assembly is placed on a container having squeezable walls and the container is squeezed, the central portion of the flexible disc is moved out of sealing relation with the stem to permit the contents to be dispensed. When the squeezing force is removed, the central portion of the flexible disc returns to sealing relation with the stem.

DESCRIPTION OF THE PREFERRED EMBODIMENTS

Figure 1:
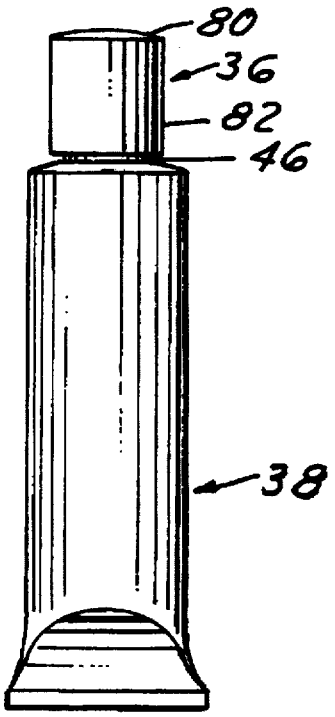
FIG. 1 is an elevational view of a self-sealing closure assembly embodying the invention on a squeezable plastic container.
Figure 3:
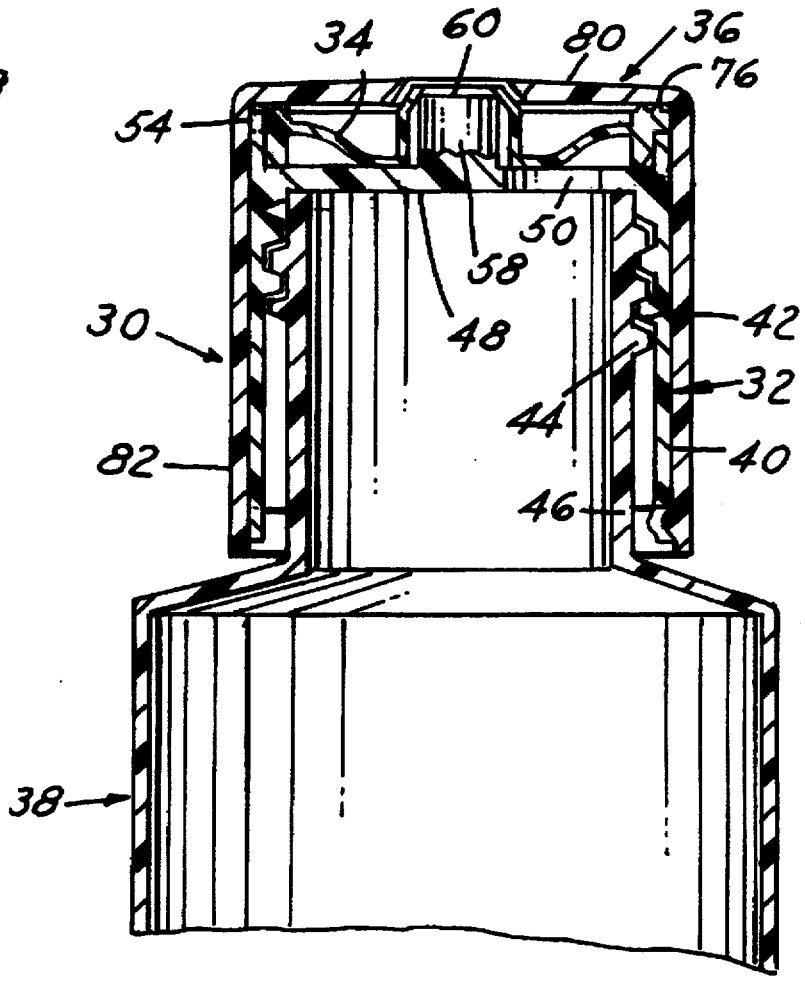
FIG. 3 is a top plan view of the closure assembly.
Figure 2:
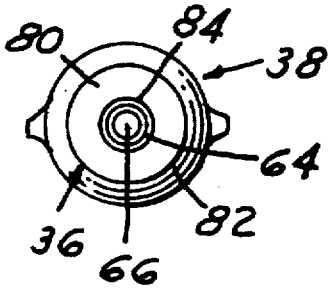
FIG. 2 is an elevational view of the closure assembly.
Figure 5:
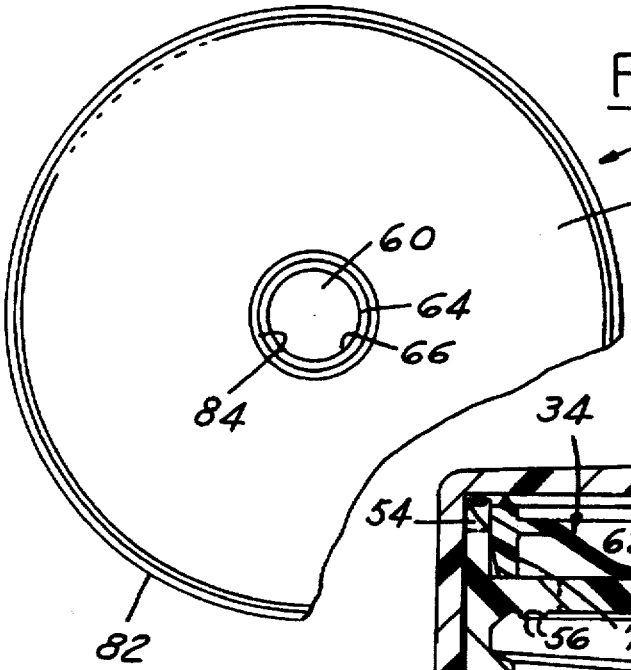
FIG. 5 is a sectional view taken along the line 5—5 in FIG. 3.
Figure 4:
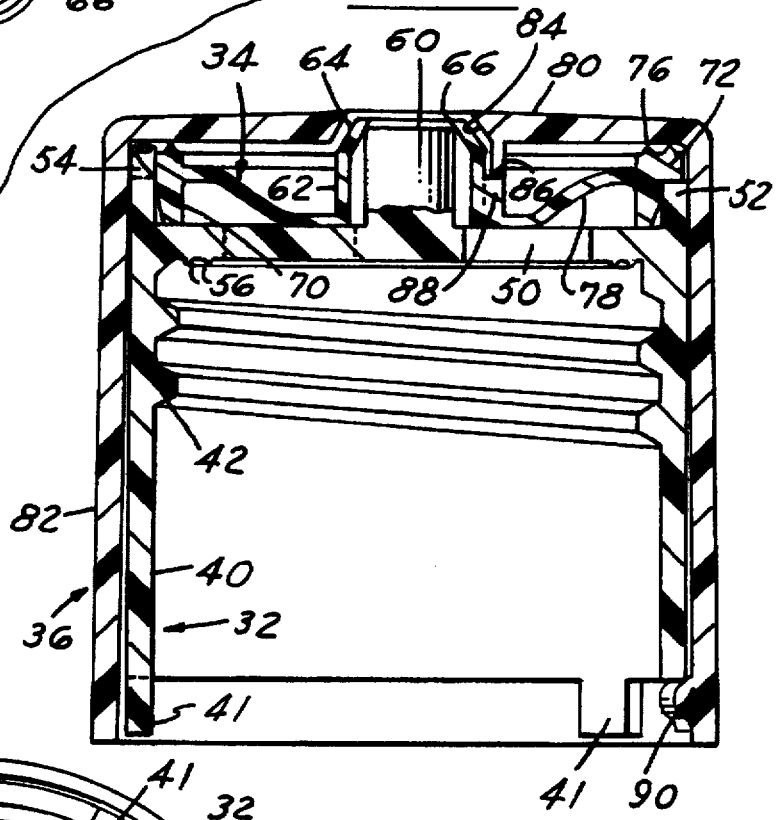
FIG. 4 is a bottom plan view of the closure assembly.
Figure 6:
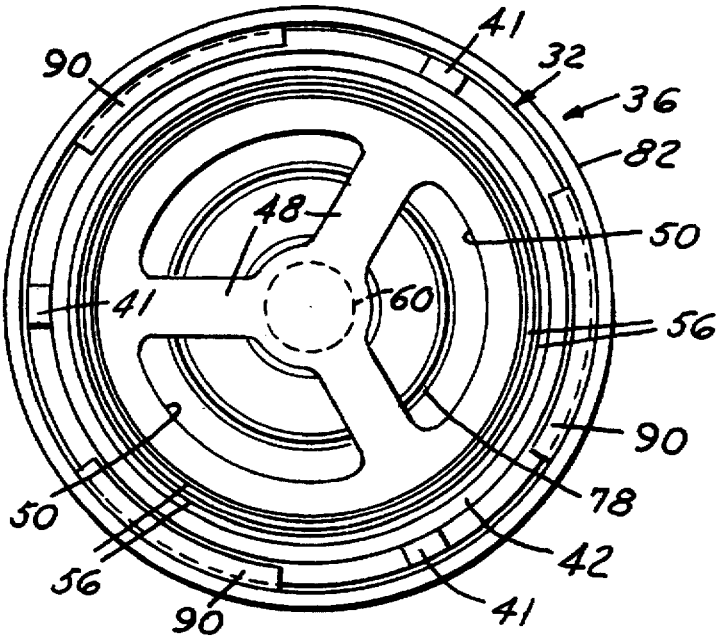
FIG. 6 is a fragmentary view similar to FIG. 5 showing the closure assembly on a plastic container.

Referring to FIGS. 1–6, the self-sealing plastic closure assembly 30 embodying the invention comprises a plastic body or base 32, a flexible disc 34 and an overcap 36. The closure assembly 30 is attached to a squeezable plastic container 38 such as a plastic tube, as presently described.

The base 32 includes a cylindrical wall 40 having internal threads 42 for engaging complementary threads 44 on the finish 46 of the plastic container 38. The base 32 also includes an integral transverse wall 48 having circumferentially spaced generally triangular openings 50 therethrough (FIGS. 13–16). A short annular wall 52 extends axially from transverse wall 48 and has an outer surface concentric with the outer surface of cylindrical wall 40. An axial projection 54 extends from wall 52. The inner surface of transverse wall 48 is formed with integral radially spaced annular ribs 56 for engaging the finish 46 of the plastic container 38. Base 32 further includes a cylindrical stem 58 that extends upwardly from transverse wall 48 and has a closed end 60.

Figure 16:
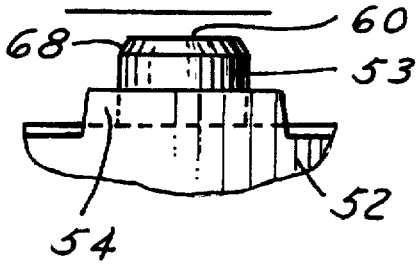
FIG. 16 is a fragmentary elevational view of a portion of the base.
Figure 17:
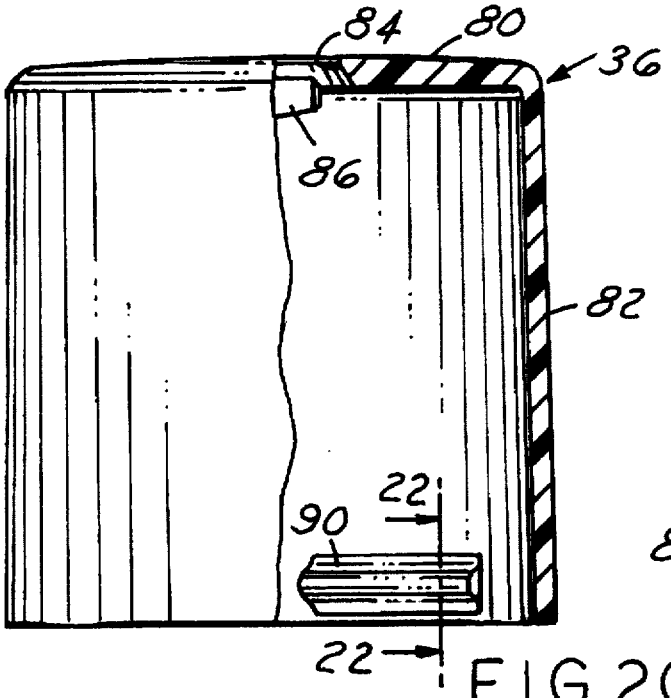
FIG. 17 is a part sectional elevational view of an overcap utilized in the closure assembly.
Figure 19:
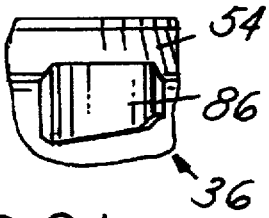
FIG. 19 is a fragmentary view taken along the line 19—19 in FIG. 18.
Figure 21:
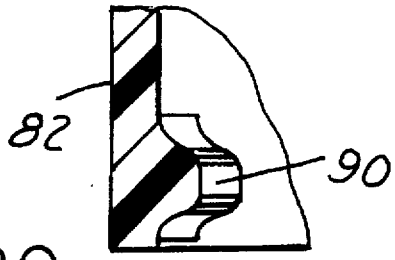
FIG. 21 is a fragmentary sectional view on an enlarged scale taken along the line 21—21 in FIG. 18.
Figure 20:
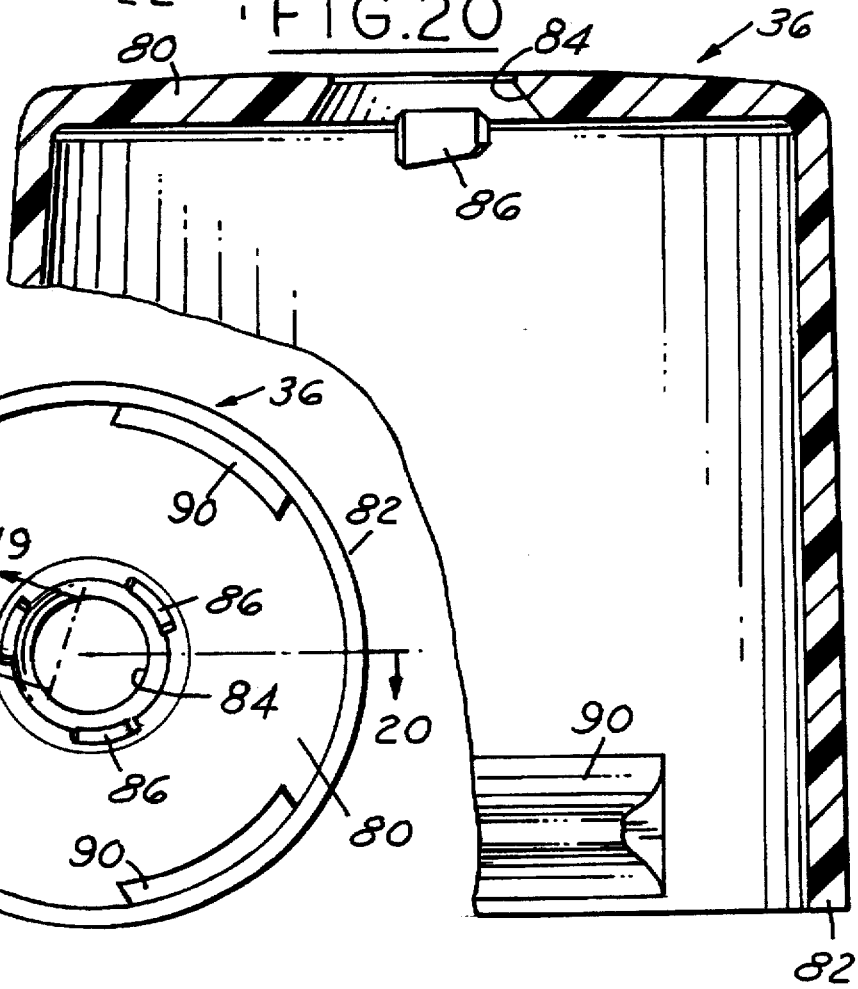
FIG. 20 is a fragmentary sectional view on an enlarged scale taken along the line 20—20 in FIG. 18.
Figure 18:
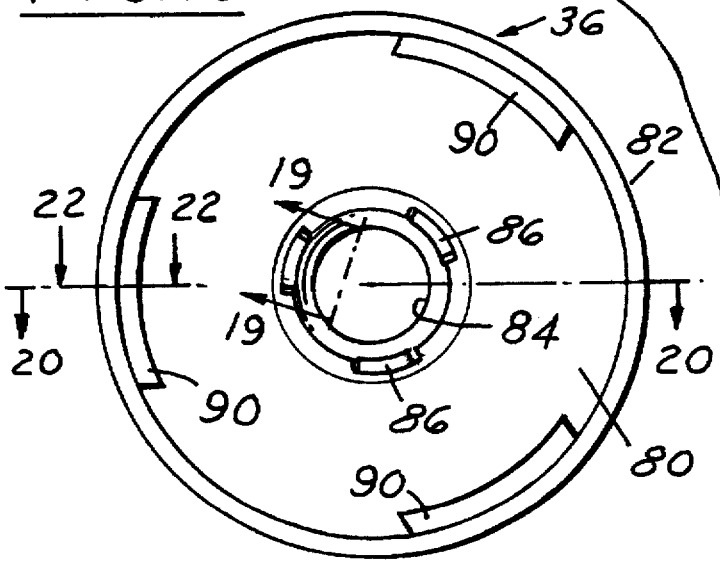
FIG. 18 is a bottom plan view of the overcap.

Referring to FIGS. 8–11, a flexible disc 34 is made of plastic and comprises a central portion 62 which has a generally cylindrical configuration and an integral inwardly and axially extending frustoconical portion 64 defining an opening 66 for sealingly engaging a frustoconical surface 68 on stem 58 (FIG. 16). Flexible disc 34 includes a peripheral relatively rigid annular wall 70 for sealingly engaging the internal surface of wall 52 on the base 32 and an integral radial flange 72 for engaging the upper surface of the wall 52. Flange 72 includes a notch 74 into which the projection 54 on wall 52 extends. Annular ribs 76 on the upper surface of the flange 72 sealingly engage the overcap, as presently described.

Flexible disc 34 includes an intermediate flexible web 78 extending from the lower end of the cylindrical portion 62 and tapers outwardly and upwardly to the interior surface of wall 70 opposite flange 72. The flexible portion 78 is imperforate.

Figure 8:
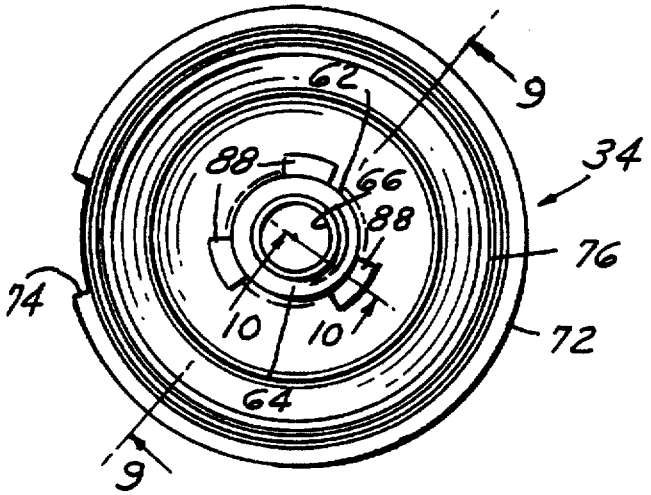
FIG. 8 is a top plan view of the flexible disc.
Figure 7:
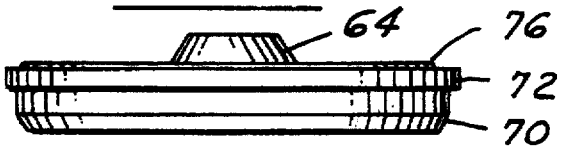
FIG. 7 is an elevational view of a flexible disc utilized in the closure assembly.
Figure 9:
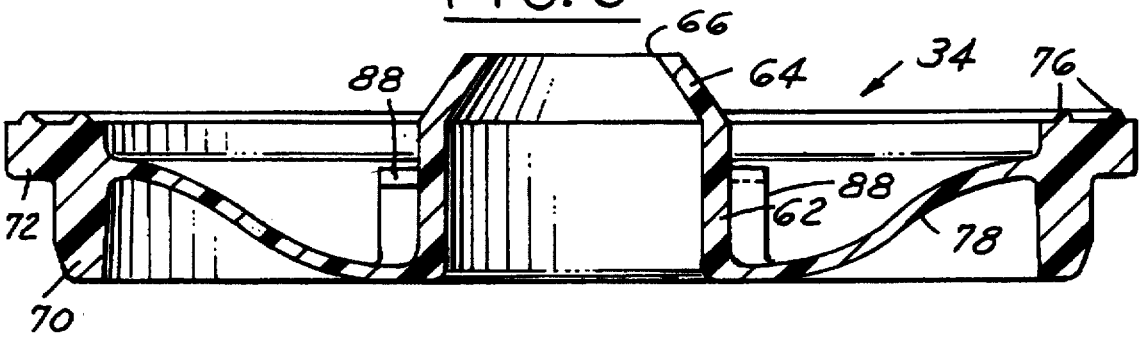
FIG. 9 is a sectional view on an enlarged scale taken along the line 9—9 in FIG. 8.
Figure 11:
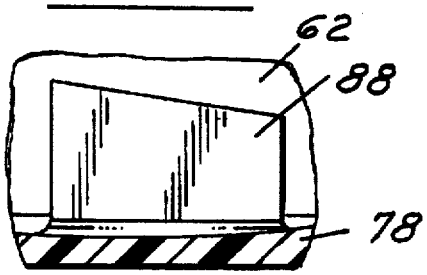
FIG. 11 is a fragmentary view taken from the right in FIG. 10.
Figure 10:
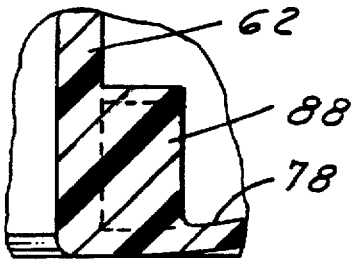
FIG. 10 is a sectional view taken along the line 10—10 in FIG. 8.
Figure 13:
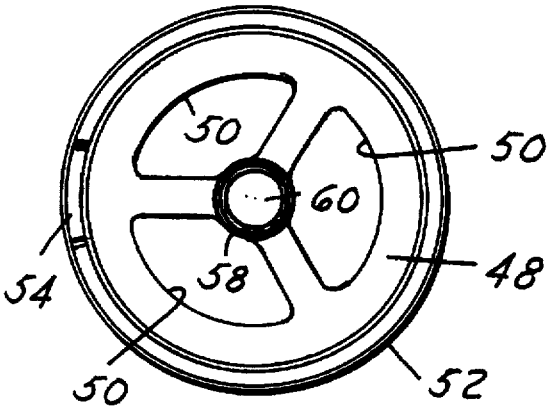
FIG. 13 is a top plan view of the base.
Figure 12:
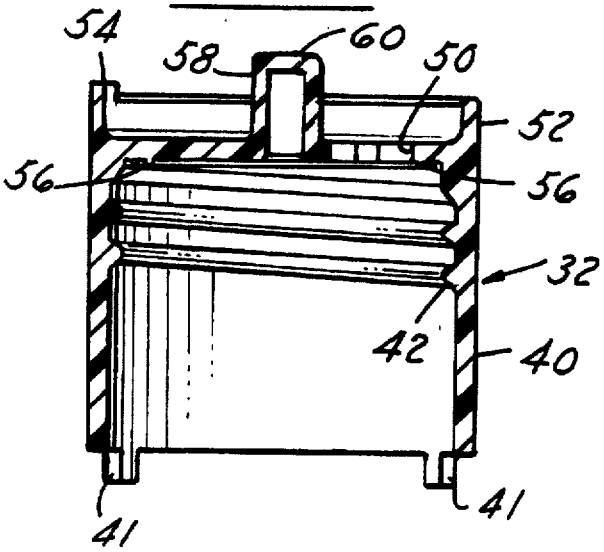
FIG. 12 is a sectional view through the base of the closure assembly.
Figure 14:
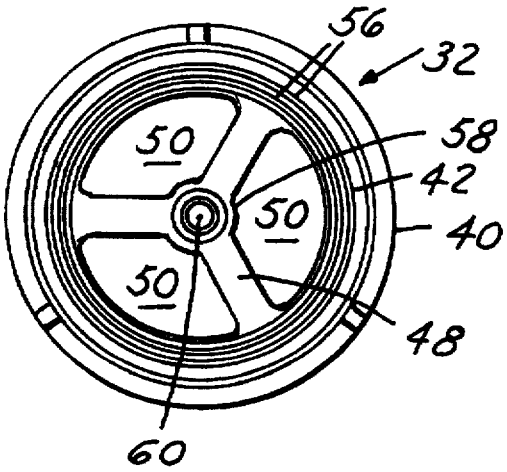
FIG. 14 is a bottom plan view of the base.
Figure 15:
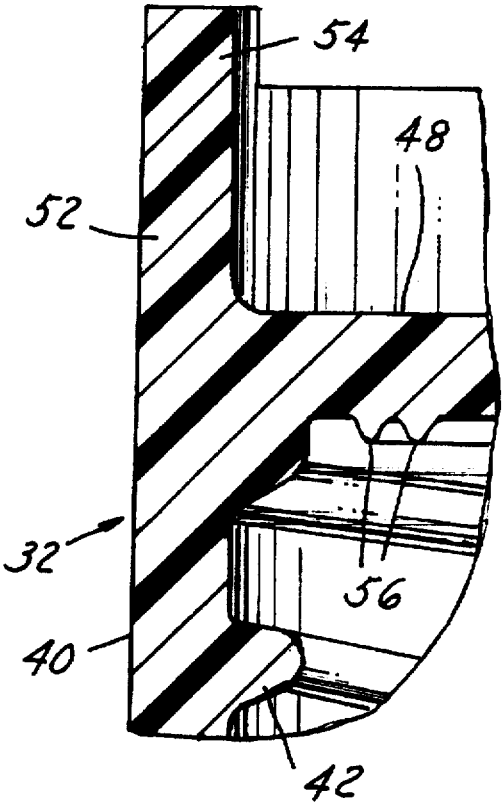
FIG. 15 is a fragmentary sectional view on an enlarged scale of a portion of the base shown in FIG. 14.

Referring to FIGS. 17–20, overcap 36 comprises a base wall 80 and an integral annular skirt 82. Base wall 80 has a central frustoconical opening 84 through which the frustoconical portion 64 of the flexible disc 34 extends. Base wall 80 further includes axially extending projections 86 which extend into the spaces between radial projections 88 on the cylindrical portion 62 of the flexible disc 34 (FIGS. 8–10). Overcap 36 further includes circumferentially spaced and circumferentially extending ribs 90 on the inner surface of the lower end of the annular skirt 82 which engage the lower end of the cylindrical wall 40 of base 32 to hold the overcap 36 in position. The cylindrical wall 40 of the base 32 includes axial portions 41 extending into the spaces between said circumferentially extending ribs 90.

Base 32 and overcap 36 are made of plastic, preferably polypropylene. Flexible disc 34 is also made of flexible plastic, preferably a thermoplastic elastomer containing a block polymer such as DYNAFLEX G-2703 made by GLS Corporation, Cary, Ill., containing a Kraton polymer made by Shell Chemical Co.

Figure 23:
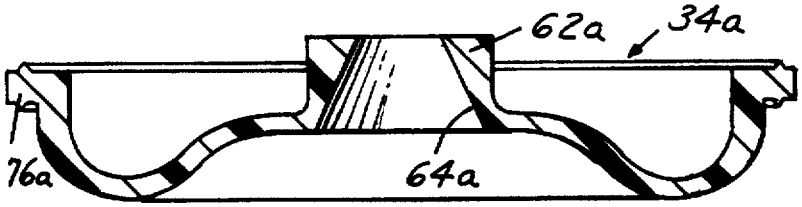
FIG. 23 is a sectional view similar to FIG. 6 showing the modified flexible disc utilized in the closure assembly shown in FIG. 22.
Figure 22:
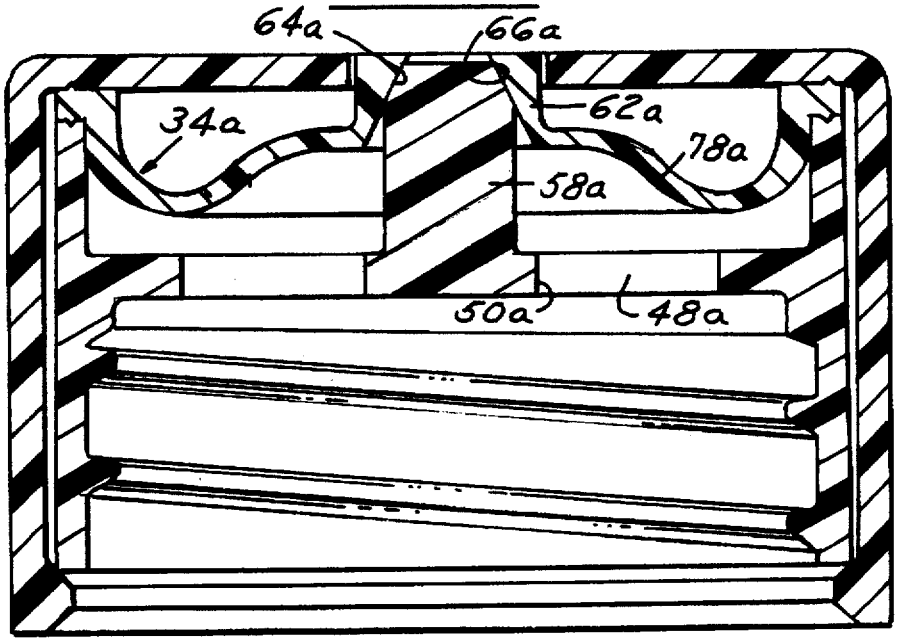
FIG. 22 is a vertical sectional view of a modified form of self-sealing closure assembly.

In the modified form of the invention shown in FIGS. 22 and 23, a modified flexible disc **34*a* is provided wherein the intermediate flexible web 40*a* extends from a central cylindrical portion 62*a* radially outwardly and concave downwardly and then upwardly to flange 64*a*. The cylindrical portion has an internal frustoconical surface 66*a*** for engaging the stem.

Figure 24:
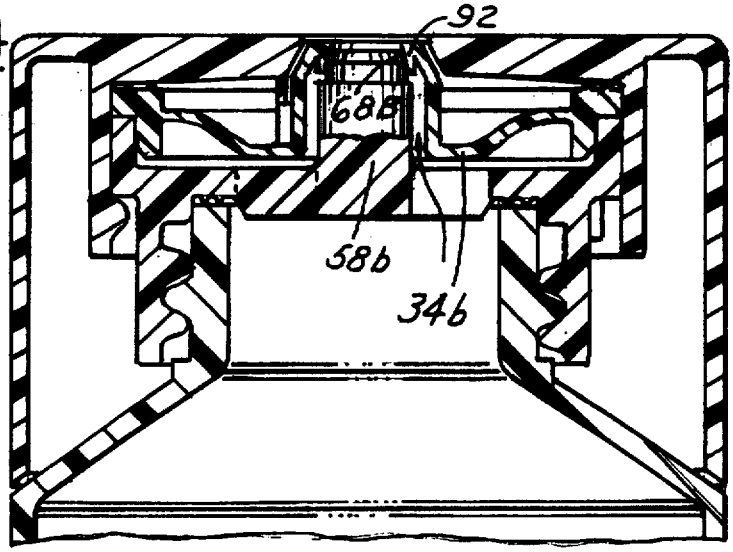
FIG. 24 is a vertical sectional view of another form of self-sealing closure assembly.

In the modified form shown in FIG. 24, the modified flexible disc **34*b* is substantially like flexible disc 34 shown in FIG. 9, except that it includes an integral annular flexible web 92. Web 92 extends axially inwardly and flexes to sealingly engage the frustoconical surface 68*b* on stem 58*b***.

It can thus be seen that there has been provided a closure for use with a container which is self-sealing and operates when the container is squeezed to open the closure for dispensing and to close the closure when the pressure on the container is released; which can be operated by only using one hand to open the sealed closure, dispense the contents and seal the closure and container.

I claim:

1. A self-sealing dispensing closure assembly comprising a base having means thereon for attachment to a flexible container, said base including at least one passage therethrough, said base including an axially extending stem, a flexible disc on said base having a central portion including an opening through which said stem extends into normally sealing relation with said central portion, and an overcap including a base wall and a skirt telescoped over said flexible disc and said base, interengaging means between said overcap and said base for holding said flexible disc in sealing relation to said base and overcap, said overcap having an opening through which said stem and said central portion of said flexible disc extends, said flexible disc including a peripheral flange portion which is clamped between the overcap and said base, said flexible disc including an inwardly and upwardly tapered portion at said central portion, said stem having a complementary sealing surface, such that when said closure assembly is placed on a container and squeezed, said central portion of said flexible disc is moved out of sealing relation with said stem to permit the contents to be dispensed, and when the squeezing force is removed, the central portion of said flexible disc returns to sealing relation with said stem, said flexible disc including an integral annular sealing web extending axially inwardly and engaging said complementary sealing surface on said stem.

2. The self-sealing dispensing closure assembly set forth in claim 1 wherein said flexible disc includes an intermediate undulating portion between said flange portion and said central portion, said intermediate portion being thinner and more readily flexed.

3. The self-sealing dispensing closure assembly set forth in claim 2 wherein said intermediate portion is generally inwardly concave.

4. The self-sealing dispensing closure assembly set forth in claim 3 wherein said inwardly concave portion is adjacent said flange.

5. The self-sealing dispensing closure assembly set forth in claim 4 wherein said inwardly concave portion is adjacent said central portion.

6. The self-sealing dispensing closure assembly set forth in any one of claims 1–5 including a plastic container having a flexible wall for squeezing.

7. A self-sealing dispensing closure assembly comprising a base, said base including a cylindrical wall having internal threads for engaging complementary threads on the finish of a flexible container, said base including an integral transverse wall having circumferentially spaced openings therethrough, said base including a short annular wall extending axially outwardly from said transverse wall and having an outer surface concentric with the outer surface of said cylindrical wall, said transverse wall having a portion radially outwardly of said openings for engaging the finish of a container, said base wall including a cylindrical stem extending upwardly from said transverse wall and having a closed end, said stem having a frustoconical surface adjacent said end, a flexible plastic disc having a central cylindrical portion extending axially outwardly and a frustoconical portion extending inwardly and axially outwardly and defining an opening sealingly engaging said frustoconical surface of said stem, said flexible disc including a relatively rigid annular wall sealingly engaging the internal surface of said short annular wall of said base and an integral radial flange engaging the upper surface of said short wall, said flexible disc including an imperforate intermediate flexible web extending from the lower end of said cylindrical portion of said disc to said rigid annular wall of said flexible disc, an overcap including a base wall and a skirt telescoped over said flexible disc and said base, said skirt of said overcap including means engaging the lower edge of said cylindrical wall of said base for holding said relatively rigid wall of said flexible disc in sealing engagement with said base wall of said overcap and said transverse wall of said base, said overcap having an opening through which said stem and said central portion of said flexible disc partially extend, such that when said closure assembly is placed on a container and squeezed, said central portion of said flexible disc is moved out of sealing relation with said stem to permit the contents to be dispensed, and when the squeezing force is removed, the central portion of said flexible disc returns to sealing relation with said stem.

8. The self-sealing dispensing closure set forth in claim 7 wherein said short annular wall of said base includes a projection and said radial flange of said wall of said flexible disc includes a notch into which said projection extends.

9. The self-sealing dispensing closure set forth in claim 7 wherein said base wall of said overcap includes axially extending projections adjacent said opening and said flexible disc includes radial projections on the cylindrical portion of said flexible disc extending in the spaces between said projections.

10. The self-sealing dispensing closure set forth in claim 7 wherein said means on said lower edge of said cylindrical wall of said overcap comprises circumferentially spaced and circumferentially extending ribs.

11. The self-sealing dispensing closure set forth in claim 10 wherein said cylindrical wall of said base includes circumferentially spaced axial portions extending into the spaces between said circumferential extending ribs.

12. The self-sealing dispensing closure set forth in claim 7 wherein said short annular wall of said base includes a projection and said radial flange of said wall of said flexible disc includes a notch into which said projection extends, said base wall of said overcap includes axially extending projections adjacent said opening and said flexible disc includes radial projections on the cylindrical portion of said flexible disc extending in the spaces between said projections.

13. The self-sealing dispensing closure set forth in claim 7 wherein said means on said lower edge of said cylindrical wall of said overcap comprises circumferentially spaced and circumferentially extending ribs, said cylindrical wall of said base includes circumferentially spaced axial portions extending into the spaces between said circumferential extending ribs.

14. The self-sealing dispensing closure assembly set forth in claim 7 wherein said intermediate portion of said flexible disc is generally inwardly concave.

15. The self-sealing dispensing closure assembly set forth in claim 14 wherein said inwardly concave portion is adjacent said flange.

16. The self-sealing dispensing closure assembly set forth in claim 15 wherein said inwardly concave portion is adjacent said central portion.

17. The self-sealing dispensing closure assembly set forth in any one of claims 7–16 including a plastic container having a flexible wall for squeezing.

* * * * *